United States Patent [19]

Cooper et al.

[11] 4,236,128

[45] Nov. 25, 1980

[54] GROUND FAULT RECEPTACLE

[75] Inventors: David A. Cooper, Loganton; William T. Monoski; Edward J. Vibert, both of Muncy, all of Pa.

[73] Assignee: GTE Products Corporation, Stamford, Conn.

[21] Appl. No.: 33,921

[22] Filed: Apr. 27, 1979

[51] Int. Cl.[3] ..... H01H 83/02

[52] U.S. Cl. ..... 335/18; 361/356

[58] Field of Search ..... 335/18; 361/356, 335, 361/357, 44, 45, 115, 46

[56] References Cited

U.S. PATENT DOCUMENTS

| | | | |
|---|---|---|---|
| 3,931,601 | 1/1976 | Anderson | 335/18 |
| 4,001,652 | 1/1977 | Klein et al. | 335/18 |
| 4,010,431 | 3/1977 | Virani et al. | 335/18 |
| 4,010,432 | 3/1977 | Klein et al. | 335/18 |
| 4,013,929 | 3/1977 | Dietz et al. | 335/18 |
| 4,084,203 | 4/1978 | Dietz et al. | 335/18 |
| 4,086,549 | 4/1978 | Slater et al. | 335/18 |

*Primary Examiner*—Harold Broome

*Attorney, Agent, or Firm*—Thomas H. Buffton

[57] ABSTRACT

A duplex electrical receptacle providing ground fault protection and mountable in an ordinary wall outlet box and including a metal support plate formed to telescope over a container of electrical insulating material and be affixed thereto and to a wall outlet box with the container having therein a pair of bus-bar conductors of identical configuration and reversibly positioned, flexible spring-like connectors coupling a power source to the bus-bar conductors, a plugable printed circuit board with associated electrical circuitry and components for detecting a ground fault condition, and a re-set guide assembly responsive to the circuitry of the printed circuit board for effecting connection and disconnection of a power source and the bus bar conductors of the receptacle.

12 Claims, 8 Drawing Figures

GROUND FAULT RECEPTACLE

TECHNICAL FIELD

This invention relates to ground fault receptacles and more particularly to ground fault circuit interrupting (GFCI) devices suitable for mounting in a wall outlet box.

CROSS REFERENCE TO RELATED APPLICATIONS

This application discloses but does not claim information set forth in the following applications concurrently filed in the names of the inventors of the present application, assigned to the Assignee of the present application, and bearing U.S. Ser. Nos. and entitled as follows: U.S. Ser. No. 33,919 entitled "Ground Fault Receptacle Re-Set Guide Assembly"; U.S. Ser. No. 33,922 entitled: "Ground Fault Receptacle Flexible Connectors"; and U.S. Ser. No. 33,920 entitled "Ground Fault Receptacle Reversible Conductors".

BACKGROUND OF THE INVENTION

In ground fault circuit interrupting (GFCI) apparatus, it is a common practice to provide structures suitable to panel board arrangements whereby the ordinary circuit breaker arrangement is directly replaced by GFCI apparatus. However, there are some applications, such as fused panel boards, wherein such direct replacement is impractical if not impossible.

Further, it is known that GFCI apparatus utilizes a differential transformer arrangement and a response to fault currents as low as 4 or 5 milliamperes is readily attainable. Moreover, it is highly desirable to provide such protection in the areas most susceptible to ground faults such as bathrooms, kitchens, swimming pools and garages for example. Thus, it is advantageous to provide a receptacle having GFCI capabilities and suitable for containment within an ordinary and nearby wall outlet box.

Additionally, it is well known that the common wall outlet box available in most present-day structures was designed to contain a simple dual receptacle rather than a dual receptacle which includes GFCI apparatus. Thus, it becomes important to utilize a maximum amount of the space available within the ordinary outlet box by enhancing and miniaturizing the design of the GFCI apparatus.

The above-mentioned miniaturization features are accomplished in the present invention by providing dual receptacles as well as a ground fault circuit interrupting (GFCI) apparatus having both test and re-set capabilities and all containable within an ordinary wall outlet box. Moreover, the uniquely designed apparatus includes such desirable features as identical reversible conductors for effecting reception of the prongs of a male plug in the dual receptacles, spring-like flexible resilient connectors responsive to a ground fault condition to effect disconnection of a power source, a floating re-set guide assembly which is efficient and inexpensive, and a simple and inexpensive modular-like construction which features insulated separation of mechanical and electrical structural features as well as plug-in type electrical connections.

SUMMARY OF THE INVENTION

In one aspect of the present invention a duplex electrical receptacle providing ground fault protection and formed for mounting in a wall outlet box includes a container of electrical insulating material having an apertured shoulder portion and a forward face portion with the forward face portion including a pair of duplex receptacles each formed to receive the prongs of a male plug and a pair of recessed portions formed to receive test and re-set buttons. The container is formed to receive a pair of substantially identical bus-bar conductors in inverse positional location and a pair of resilient connectors affixed to a conductor of a power source selectively connectable to the bus-bar conductors. A re-set guide assembly including ground fault circuit interrupting apparatus is disposed within the container and connected to a re-set button assembly and to the flexible connectors. Moreover, a plug-in type circuit board is disposed within the container and separated from the mechanism thereof by a insulating panel member and is responsive to a ground fault condition for activating the ground fault circuit interrupting apparatus to effect disconnection of the power source from the bus-bar conductors and, in turn, from the load connected to the bus-bar conductors.

BEST MODE FOR CARRYING OUT THE INVENTION

For a better understanding of the present invention, together with other and further objects, advantages and capabilities thereof, reference is made to the following disclosure and appended claims in connection with the accompanying drawings.

Figure 1:
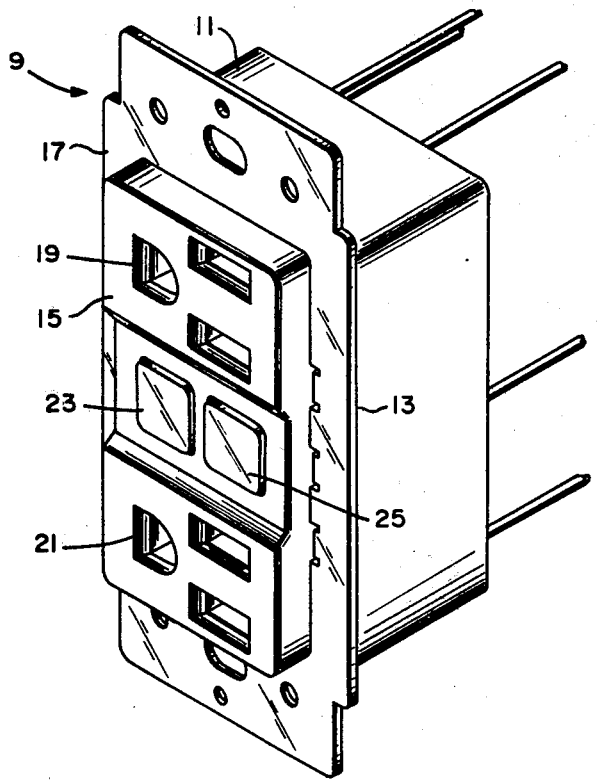
FIG. 1 is a perspective view of the dual electrical receptacle of the present invention.

Referring to the drawings, FIG. 1 illustrates the duplex electrical receptacle of the present invention which provides ground fault protection and is formed for mounting in a wall outlet box. The receptacle 9 includes a container 11 of electrical insulating material, such as a suitable plastic material, having an apertured shoulder portion 13 extending to a forward face portion 15. An electrically conductive metal mounting plate 17 is telescoped over the forward face portion 15 and into contact with the shoulder portion 13 of the container 11. Also, the forward face portion 15 includes a pair of female sockets 19 and 21 for receiving a conventional two or three pronged male plug. Moreover, the forward face portion 15 is formed to accommodate a test button 23 and a reset button 25 which will be more fully explained hereinafter.

Figure 2:
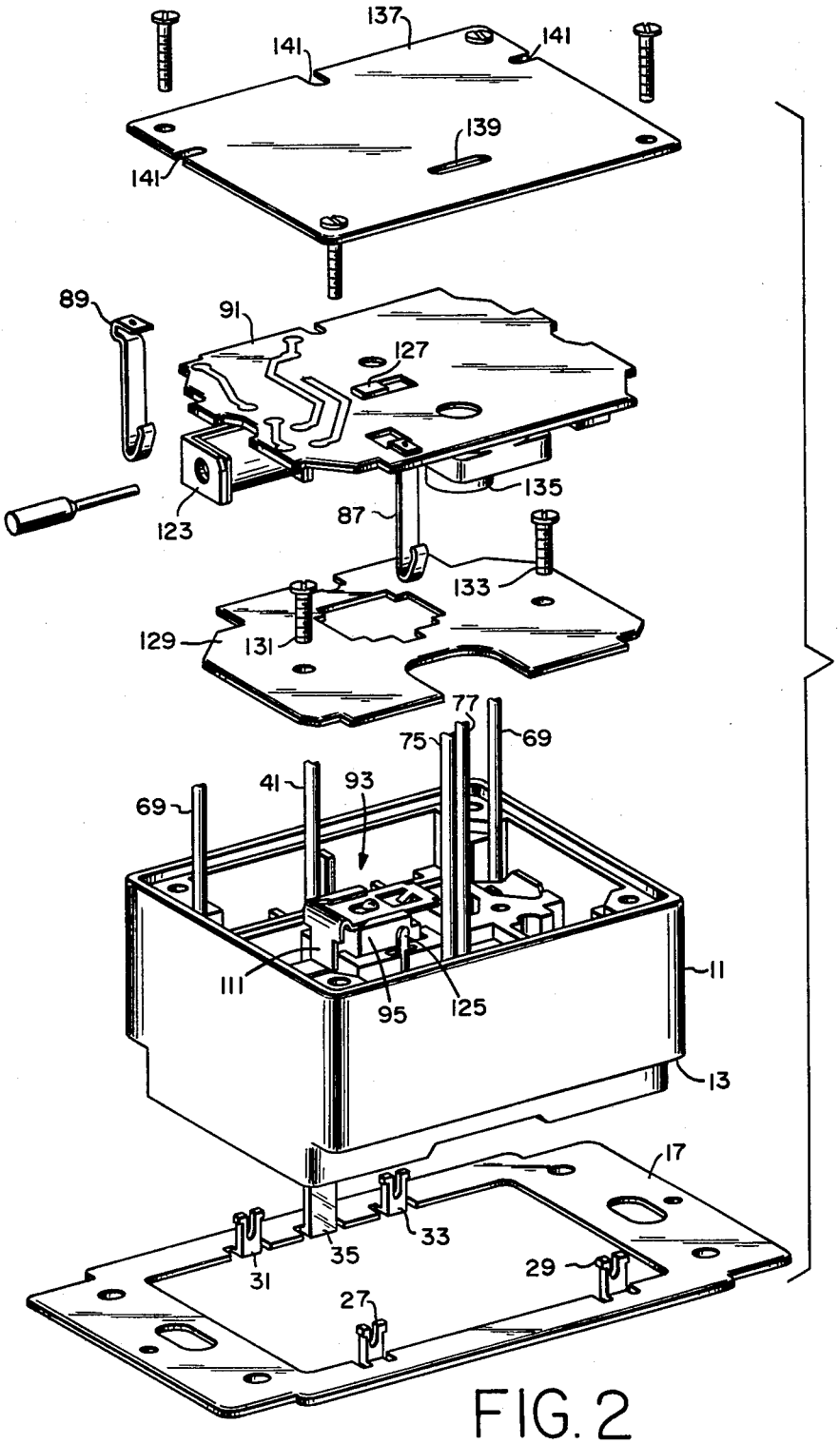
FIG. 2 is an exploded perspective view of the dual receptacle of the present invention.
Figure 3:
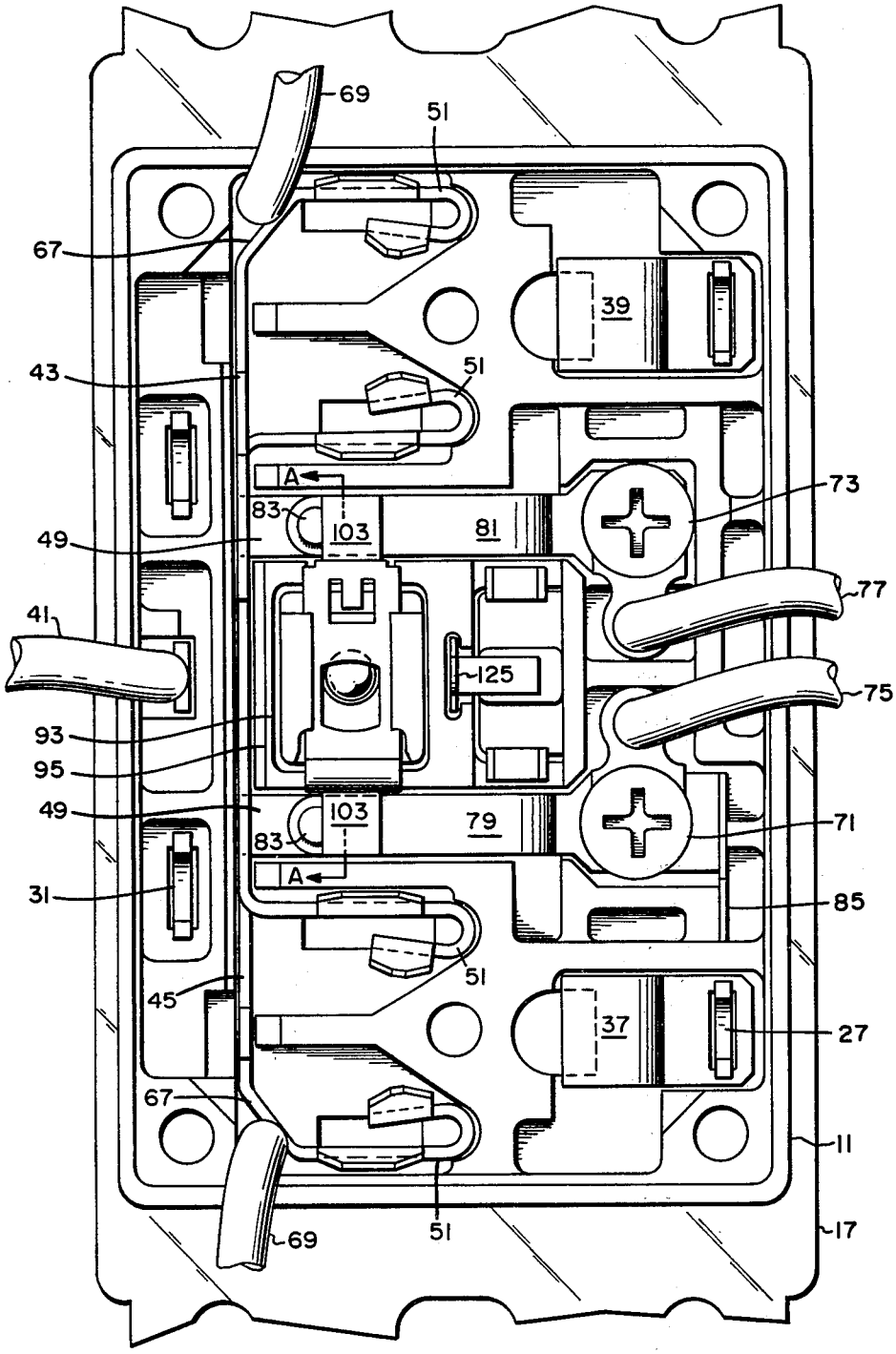
FIG. 3 is a plan view of the container of FIG. 2.

More specifically, the exploded view of FIG. 2 and the plan view of FIG. 3 present the operational mechanism of the receptacle 9 of FIG. 1. Herein, the metal mounting plate 17 includes a plurality of split tab members 27, 29, 31, 33 and a grounding post 35 which are formed to pass through the apertures of the shoulder portion 13 of the container 11. Each of the split tab members 27 and 29 has a grounding connector 37 and 39 of FIG. 3 respectively, telescoped thereover and affixed by staking of the split tab members 27 and 29. Moreover, each of the grounding connectors 37 and 39 of FIG. 3 is formed to receive the grounded prong of a male plug via the female sockets 19 and 21 of the face portion 15. The other two split tab members 31 and 33 are also staked to affix the metal mounting plate 17 to the container 11. Also, a grounding wire 41 is soldered or welded to the grounding post 35 of the metal mounting plate 17 and extends through the container 11.

Disposed within the container 11 is a pair of substantially identical inversely positioned bus bar conductors, 43 and 45 of FIG. 3. Each of these bus bar conductors 43 and 45 includes an electrical contact receiving member 47 and 49. A dual female receiving portion 51 is disposed at opposite ends of each one of the bus bar conductors 43 and 45.

Figure 4:
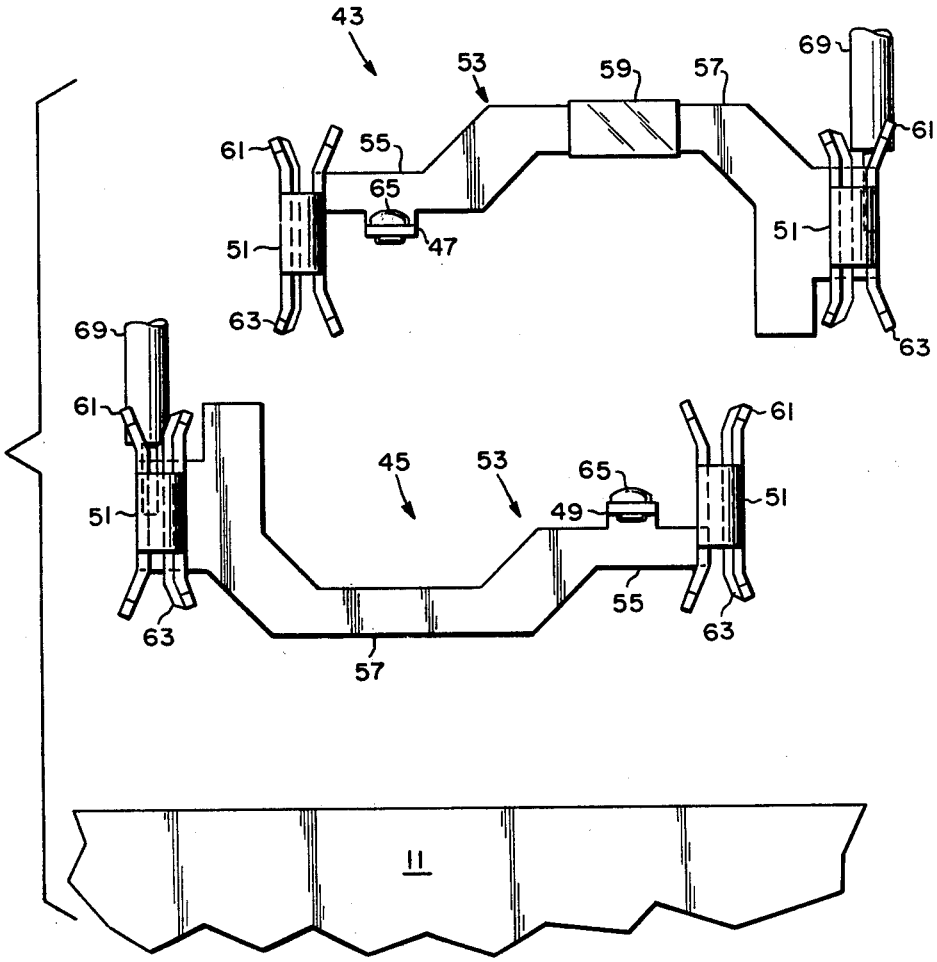
FIG. 4 is an illustration of the identical reversible bus-bar conductor of FIG. 2.

As can be more clearly seen in FIG. 4, each of the bus bar conductors 43 and 45 is of substantially identical configuration with an interconnecting member 53 having first and second longitudinally connected and off-set portions 55 and 57 respectively. Moreover, one of the second off-set portions 57 includes a covering of mylar tape 59 to inhibit arcing. The interconnecting member 53 is connected to female prong receiving portions 51 located at the opposite ends thereof. Each of these female prong receiving portions 51 has an upper prong receiving portion 61 and a lower prong receiving portion 63 and is of flat stock material in a substantially "U"-shaped configuration bent back upon itself to provide a prong receiving space.

Also, the first off-set portion 55 of each of the interconnecting members 53 includes an outwardly extending electrical contact receiving member, 47 and 49 respectively. Each of these contact receiving members 47 and 49 is located along the horizontal axis of the bus bar conductors 43 and 45 formed to receive an electrical contact 65. Moreover, the mating surface for the electrical contact 65 on each of the bus bar conductors is positioned on the same horizontal axis even though one of the electrical contacts is assembled to face upward and the other downward with respect to the first off-set portion 55. Thus, the substantially identical bus bar conductors 43 and 45 may be positionally reversed, afterwhich, the interconnecting members 53 are fabricated in a substantially identical manner, to provide for receiving the prongs of a male receptacle and to provide electrical contact for each one of the bus bar conductors 43 and 45.

Further, each one of the bus bar conductors 43 and 45 is formed to provide a female prong receiving portion 51 at one end which is at an angle of about 90° with respect to the horizontal axis of the bus bar conductors 43 and 45. At the opposite end of each of the bus bar conductors 43 and 45, the female prong receiving portion 51 is angled at 90° from the horizontal axis by way of a pair of bend angles of about 45° whereby a relatively flat surface 67 of FIG. 3 on each of the bus bar conductors 43 and 45 is provided. On this flat surface 67, a conductor 69 is affixed to provide electrical connection therefrom to a load circuit located downstream from the power source.

Referring back to FIG. 3, a pair of conductors 75 and 77 connectable to a power source (not shown) are disposed within the container 11 and affixed thereto by a pair of screws 71 and 73. Each of the conductors 75 and 77 is held in contact with one of a pair of flexible resilient spring-like members 79 and 81 each having an electrical contact 83 at one end thereof and aligned with an electrical contact 65 of the bus bar conductors 43 and 45. Moreover, one of the spring-like members 79 includes an upstanding portion 85 of FIG. 3 formed for electrical connection to one spring connector 87 of FIG. 2.

The spring connector 87 of FIG. 2 is similar to one or more flexible plug-type spring connectors 89 and includes a so-called snap-on feature at one end. Thereat, the spring connectors 87, 89 have a strip material bent back upon itself with a dimple therein formed for mating the usual aperture encountered in printed circuit board structures. Moreover, the bent back strip material is formed to slip over the circuit board and be affixed thereto in a manner such that the opposite end thereof, which is a flat stock material in a U-shaped configuration, is self-aligned.

Figure 5:
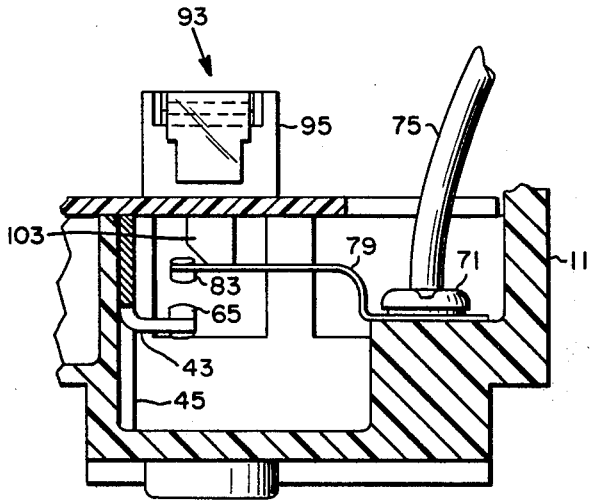
FIG. 5 is a cut-away illustration of the flexible connectors associated with the illustration of FIG. 3.

Referring to the cross-sectional illustration of FIG. 5, it can readily be seen that the spring-like member 79 is electrically coupled to a conductor 75 connected to a power source (not shown) and has an electrical contact 83 which is selectively connectable to a contact 65 of one of the bus bar conductors 43. Moreover, this spring-like member 79, as compared with braid and other known connecting means, is readily deformable to provide the desired electrical connection between a power source and the bus bar conductors 43 and 45. Also, the desired deformation of the spring-like member 79 is accomplished by a re-set guide assembly 93 disposed within the container 11.

Figure 6:
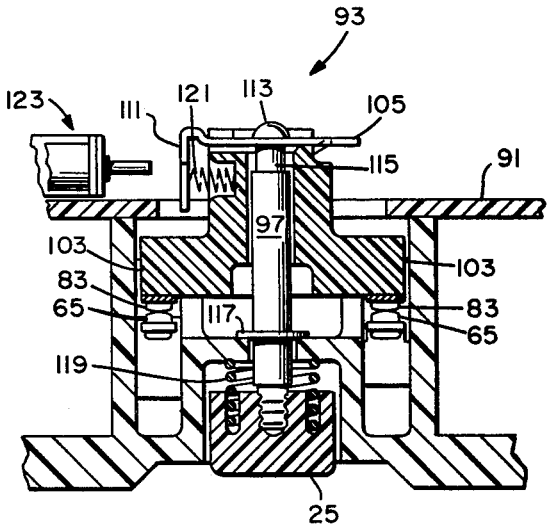
FIGS. 6 and 7 are cross sectional illustrations along a line A—A of FIG. 3 illustrating the ground fault interrupting circuit (GFIC) apparatus of FIG. 2 in closed and open positional locations.

Referring to the re-set guide assembly 93, this re-set guide assembly 93 includes a substantially oblong-shaped re-set guide member 95 of FIGS. 2, 3, 6 and 7, having a central aperture, 97 of FIG. 6, extending along a longitudinal axis; a slotted end 99 normal to the longitudinal axis; a spring-receiving hole 101 spaced from the slotted end 99 and directed normal to the longitudinal axis; and a pair of outstanding ear members 103 oppositely disposed on the re-set guide member 95, spaced from the slotted end 99 and the spring-receiving hole 101, and extending normal to the longitudinal axis.

A latch member 105 of substantially flat material has a central aperture 107 formed for alignment with the central aperture 97 of the re-set guide member 95. A locking barb-like tab member, 109 of FIG. 7, captures the latch member 105 in slidable engagement within the slotted end 99 of the re-set guide member 95. The latch member 105 also includes a substantially "L"-shaped end portion 111 formed to cover the spring-receiving hole 101 of the re-set guide member 95.

A guide pin 113 having a latching groove 115 and a retaining ring 117 affixed thereto is embedded into a re-set button 25 of FIG. 1 with a spring 119 captured intermediate the forward face portion 15 of the container 11 and the re-set button 25. The re-set button 25 is disposed within a re-set button receiving portion of the face portion 15 of the receptacle 9 and the guide pin 113 extends along the longitudinal axis and within the central aperture 97 of the re-set guide member 95. Moreover, the guide pin 113 extends through the central aperture 107 of the latch member 105 and the latch member 105 is selectively engaged and disengaged from the latching groove 115 of the latch member 105 in accordance with the positional location of the latch member 105 as determined by the "L"-shaped end portion 111 thereof. Moreover, this positional location of the "L"-shaped end portion 111 is dependent upon a spring member 121 disposed within the spring receiving hole 101 of the re-set guide member 95 and an adjacent solenoid 123 having an operational function to be explained hereinafter.

Figure 8:
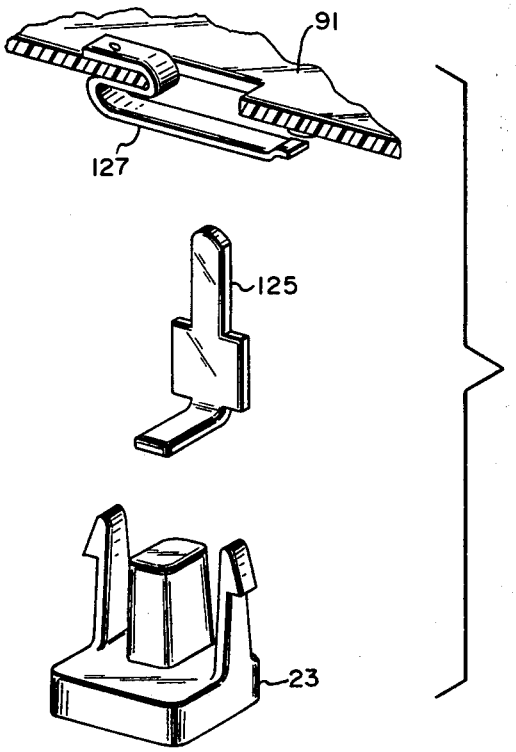
FIG. 8 is a cut-away illustration of the test button operation of the electrical receptacle of the present invention.

Also, a test button extension, 125 of FIGS. 2, 3 and 8, is disposed within the container 11 and aligned with the test button 23 of FIG. 1. This test button 23 is formed for disposal within a test button receiving portion of the face portion 15 of the receptacle 9. Depression of the test button 23 causes the test button extension 125 of FIGS. 2 and 8 to activate a flexible member 127 of FIGS. 2 and 8 affixed to the printed circuit board 91. In turn, the flexible connector 127 contacts a conductive portion of the circuit board 91 and thereby effects a change in current flow or a ground fault condition in the circuitry of the printed circuit board 91. As a result, the above-mentioned re-set guide assembly 93 is activated as will be explained hereinafter.

Telescoped over the re-set guide assembly 93, the test button extension 125, and the conductors 75 and 77 connected to a power source is a pane member 129 of electrical insulating material. This panel member 129 is affixed to the container 11 by a pair of screws 131 and 133 and serves to mechanically confine the components within the container 11.

A printed circuit board 91 having an electrical circuit affixed thereto as well as a solenoid 123 and the flexible member 127 also has a pair of spring connectors 87 and 89. The circuit board 91 includes a differential current transformer 135 of FIG. 2 which is telescoped over the conductors 75 and 77 connected to a power source. The one spring connector 87 provides electrical and mechanical contact between the printed circuit board 91 and the upstanding portion, 85 of FIG. 3, of the spring-like member 79. At the same time, the other spring connector 89 provides electrical and mechanical contact between the printed circuit board 91 and one of the bus bar conductors 45. Moreover, the solenoid 123 is positioned in operational relationship with the "L"-shaped end portion 111 of the latch member 105 of the re-set guide assembly 93.

A back panel member, 137 of FIG. 2, has a slot 139 for passage therethrough of the conductors 75 and 77 connected to a power source and a plurality of slots 141 for passage of the ground wire 41 and the conductors 69 for connection to a downstream load circuit. This back panel member 137 is affixed to the container 11 and substantially seals the components therein.

As to operation of the above-described duplex electrical receptacle 9, the conductors 75 and 77 are connected to a 60 Hz 120 V A.C. power source available within an ordinary wall outlet box. The ground wire 41 is connected to a ground circuit also available within the wall outlet box and the conductors 69 are connected to a load, such as another receptacle for example, downstream of the power source. In a manner well-known in the art, a ground fault condition at the receptacle 9 or at the receptacle downstream thereof causes an alteration in current flow in the conductors 75 and 77 whereby the differential current transformer 135 on the circuit board 91 is activated to effect disconnection of the power source.

Figure 7:
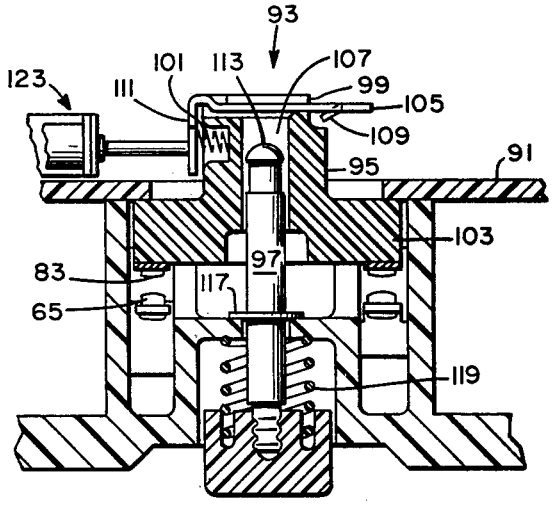

Further, the receptacle 9 is energized by activation of the re-set guide assembly 93. Referring to FIGS. 6 and 7 the re-set guide assembly 93 is activated by depressing the re-set button 25. Thereupon, the spring 119 is compressed and the guide pin 113 passes through the central aperture 107 of the latch member 105 causing the latch member 105 to slide in the slotted end 99 of the re-set guide member 95 and the "L"-shaped end portion 111 to compress the spring member 121.

As pressure is continued on the re-set button 25, the spring member 121 slides the latch member 105 into engagement with the latching groove 115 of the guide pin 113. Thereupon, finger pressure is released and the spring 119 imparts a force on the re-set guide member 95 in an amount sufficient to cause the re-set guide member 95 to advance in the direction of the re-set button 25. Moreover, the outstanding ear members 103 of the re-set guide member 95 contact the spring-like members 79 and 81 and the force exerted thereon due to the spring 119 is of an amount sufficient to overcome the resilience of the spring-like members 79 and 81 and cause electrical connection of the electrical contacts 83 thereon and the electrical contacts 65 of the bus bar conductors 43 and 45. Thus, energy from a power source is applied by way of the conductors 75 and 77, spring-like members 79 and 81 and electrical contacts 83 to the electrical contacts 65 of the bus bar conductor 43 and 45.

Additionally, the receptacle 9 is readily tested for response to a ground fault condition by depressing the test button 23 of FIG. 1 whereupon the test button extension 125 of FIGS. 2 and 8 encounters the flexible member 127 of the printed circuit board 91 which comes into subsequent contact with a conductor on the printed circuit board 91 to effect an unbalance in current flow through the differential transformer 135. This unbalanced current flow causes activation of the solenoid 123 whereupon the plunger of the solenoid 123 contacts the "L"-shaped end portion 111 of the latch member 105, as illustrated in FIG. 7. This action causes the latch member 105 to overcome the bias of the spring 121 and to slide in the slotted end 99 of the re-set guide member 95.

Thereupon, the latch member 105 is removed from the latching groove 115 of the guide pin 113 and the spring 119 is released causing the re-set button 25 to protrude from the face portion 15 of the receptacle 9. At the same time, the pressure exerted on the re-set guide member 95 due to the compression of the spring 119 is released whereupon the re-set guide member 95 is moved upwardly by the spring-like members 79 and 81 of FIG. 3. As a result, connection of the electrical contacts 65 and 83 is interrupted whereupon power to the bus bar conductors 43 and 45 from the conductors 75 and 77 connected to a power source is disconnected.

While there has been shown and described what is at present considered the preferred embodiment of the invention, it will be obvious to those skilled in the art that various changes and modifications may be made therein without departing from the invention as defined by the appended claims.

INDUSTRIAL APPLICABILITY

Thus, an enhanced duplex electrical receptacle for mounting in an ordinary wall outlet and connecting to a power source is connectable to and provides ground fault protection for the receptacle as well as other receptacles downstream of the power source. The receptacle is a unique structure of greatly simplified construction and includes such features as an improved grounding system utilizing a wall mounting metal support plate, a bus bar conductor which is reversible and includes oppositely disposed male plug receiving portions whereby a single structure is reversible for providing connection to dual receptacles and both prongs of a male plug. Also, spring-like flexible connectors, as opposed to the usual metal braid type, are utilized for providing electrical connection to the bus bar conductors. Moreover, a simplified electrical test technique as well as a unique re-set guide assembly not only provides a readily available test procedure but also an enhanced ground fault indicating and protective system.

Additionally, the construction is greatly simplified because of the utilization of a printed circuit board having attached components such as a solenoid and differential current transformer. Also, the printed circuit board 91 is preferably plugged into the receptacle and coupled by spring connectors although soldering may be used. Further, the total package is easily assembled with the mechanical components essentially separated from the electrical components whereby replacement or substitution of portions of the receptacle either during or after assembly is readily accomplished.

We claim:

1. In a duplex electrical receptacle providing ground fault protection and formed for mounting in a wall outlet box and for connecting an electrical load to the conductors of a power source, the improvement comprising:

a container of electrical insulating material having an apertured shoulder portion extending to a forward face portion, said forward face portion having a pair of recessed portions formed to receive a test button and a re-set button respectively and a pair of duplex receptacles each formed to receive a ground connection prong and the prongs of a male plug;

a metal support plate formed to telescope over said forward face portion and contact said shoulder portion of said container, said metal support plate having means for attachment thereof to a wall outlet box and a plurality of outstanding tab members formed to extend through said apertured shoulder portion and affix said metal support plate to said container;

a pair of bus-bar conductors disposed within said container, each of said conductors having an electrical contact member affixed thereto and a male prong receiving portion aligned with each of said duplex receptacles;

first and second resilient connectors each attached to an electrical conductor of said power source and having an electrical contact member aligned with the electrical contact member of one of said pair of bus-bar conductors;

a re-set guide assembly disposed within said container and affixed to a re-set button disposed within one of said recessed portions of said face portion, said re-set guide assembly including ground fault circuit interrupting apparatus for effecting and interrupting contact between said electrical contact members of said bus-bar conductors and said first and second resilient connectors;

a test button assembly including a test button disposed within one of said recessed portions of said face portion and a test button extension within said container and responsive to said test button for simulating a ground fault condition;

a panel member of electrical insulating material disposed within said container and substantially covering said bus-bar conductors and resilient connectors and telescoped over said re-set guide and test button assemblies;

a printed circuit board disposed within said container adjacent said panel member and including ground fault circuitry having a differential transformer telescoped over said electrical conductors of said power source, a solenoid adjacent said re-set guide assembly, and at least a pair of flexible plug-in spring members formed provide electrical connection of said power source conductors to said printed circuit board; and a back cover member of electrical insulating material affixed to said container substantially covering said printed circuit board.

2. The improvement of claim 1 wherein said test and re-set buttons and said recessed portions for receiving said buttons are of substantially identical configurations.

3. The improvement of claim 1 wherein said metal support plate includes a grounding tab extending through said apertured shoulder portion of said container and formed for attachment of a grounding wire thereto.

4. The improvement of claim 1 wherein said plurality of outstanding tab members of said metal support plate extending through said apertured shoulder portion of said container are of a form to be staked for affixing said metal support plate to said container.

5. The improvement of claim 1 including an outstanding tab member of said metal support plate adjacent the portion of each of said pair of duplex receptacles formed to receive a ground connection and a ground connector for each of said pair of duplex receptacles affixed to one of said tab members.

6. The improvement of claim 1 wherein said pair of bus-bar conductors are of substantially identical configuration and disposed in inverse positional relationship within said container.

7. The improvement of claim 1 wherein said first and second resilient connectors are each fabricated of a spring-like material with an electrical contact member affixed at one end thereof.

8. The improvement of claim 1 wherein said re-set guide assembly includes a spring-loaded guide pin and latch assembly responsive to a ground fault condition for effecting disconnection of said contact members of said first and second resilient connectors and said bus-bar conductors.

9. The improvement of claim 1 wherein said test button assembly includes a flexible electrically conductive spring members affixed to said printed circuit board and responsive to activation of said test button for simulating a ground fault condition in said electrical circuitry of said printed circuit board.

10. The improvement of claim 5 wherein each of said ground connectors is formed from a single piece of flat-rolled electrically conductive stock material and contoured to receive a ground connection prong.

11. The improvement of claim 1 wherein each of said flexible plug-in spring members is formed to snap on said circuit board and self-align for said electrical connection of said conductors of said power source.

12. The improvement of claim 1 wherein each one of said flexible plug-in spring members is formed to snap on said circuit board and self align an opposite end of substantially "H"-shaped configuration to provide electrical connection to said conductors of said power source.

* * * * *